US006417781B1

(12) United States Patent
Matsumoto

(10) Patent No.: US 6,417,781 B1
(45) Date of Patent: Jul. 9, 2002

(54) SHORT RANGE WIRELESS COMMUNICATION USING ON-BOARD APPARATUS

(75) Inventor: Manabu Matsumoto, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/662,919

(22) Filed: Sep. 15, 2000

(30) Foreign Application Priority Data

Oct. 7, 1999 (JP) ..... 11-286828

(51) Int. Cl.[7] ..... G08G 1/00

(52) U.S. Cl. ..... 340/901; 340/928; 340/905; 340/539; 340/933; 340/937; 340/932.2; 340/903; 701/13; 701/211; 701/24; 701/26; 342/457; 342/422; 342/158

(58) Field of Search ..... 340/901, 928, 340/905, 539, 933, 937, 932.2, 903; 701/13, 211, 24, 26; 342/457, 422, 158

(56) References Cited

U.S. PATENT DOCUMENTS 5,424,727 A * 6/1995 Shieh ..... 340/928
5,602,919 A * 2/1997 Hurta et al. ..... 380/24
5,710,566 A * 1/1998 Grabow et al. ..... 342/457
5,805,082 A * 9/1998 Hassett ..... 340/928
5,806,018 A * 9/1998 Smith et al. ..... 701/211
5,910,782 A * 6/1999 Schmitt et al. ..... 340/995
5,939,976 A 8/1999 Sasaki et al. ..... 340/435
6,154,152 A * 11/2000 Ito ..... 340/988

FOREIGN PATENT DOCUMENTS

JP 6-215271 8/1994 ..... G07G/1/12
JP 8-297761 11/1996 ..... G07B/15/00
JP 9-119339 5/1997 ..... F02D/45/00

* cited by examiner

*Primary Examiner*—Jeffery Hofsass
*Assistant Examiner*—Tai T. Nguyen
(74) *Attorney, Agent, or Firm*—Law Offices of David G. Posz

(57) ABSTRACT

A fixed station and an on-board apparatus are constructed to carry out a short range communication. The on-board apparatus specifies an application from a command included in reception data received from the fixed station and starts a corresponding processing, when an acquired command is a menu selection command. A menu including commodities and charges are displayed. When a selected item is determined, the determined content is displayed. When an IC card unit receives an IC card for settling the charge, the charge is settled by rewriting the IC card by data exchange via wireless communication. A short range wireless unit is used to ensure individuality of the communication. This short range communication may also be used at a vehicle repair shop, at a curved corner on a travel path or the like.

4 Claims, 14 Drawing Sheets

SHORT RANGE WIRELESS COMMUNICATION USING ON-BOARD APPARATUS

CROSS REFERENCE TO RELATED APPLICATION

This application relates to and incorporates herein by reference Japanese Patent Application No. 11-286828 filed on Oct. 7, 1999.

BACKGROUND OF THE INVENTION

The present invention relates to a wireless communication method which uses an on-board apparatus communicating with outside in a short range wireless communication system.

There has conventionally been known VICS (Vehicle Information and Communication System) as one of systems providing various services to a user of a vehicle by carrying out wireless communication between an on-board apparatus mounted on the vehicle and a fixed station installed outside of the vehicle for conveying to a driver, for example, road traffic information on congestion of road, vacancy of a parking lot or the like to improve traffic flow or to achieve pertinent guidance to the parking lot.

According to VICS, there is used radio wave beacon for carrying out one-way communication of an announcing type or optical beacon capable of carrying out two-way communication for providing information within a narrow or limited area.

However, in the case of radio wave beacon, owing to the one-way communication of the announcing type, communication cannot be carried out from the on-board apparatus to the fixed station. Meanwhile, in the case of optical beacon, although the two-way communication can be carried out, the optical beacon is not available to general users. Therefore, according to VICS, services of sophisticated function for general users utilizing the two-way communication cannot be realized.

In contrast thereto, there is known ATIS (Advanced Traffic Information Service) capable of carrying out the two-way communication. It utilizes a mobile communication apparatus such as a portable telephone, a car telephone or the like. However, according to ATIS, information is transmitted via a public communication network and accordingly, the transmission capacity is about 64 kbps. Thus, much time is taken for transmitting a large amount of data such as image or the like. Further, according to ATIS, information is controlled concentratedly at a center (fixed station) and accordingly, the center needs to deal with information over a wide range and cannot deal with extremely local and instantaneous information such as, for example, a behavior of an individual vehicle constituting effective information in view of promoting safety of running or the like.

Further, in wireless communication between an on-board apparatus and a fixed station, it is expected to realize personal communication with respect to a specific vehicle (on-board apparatus) accompanied by settling charge or the like. However, according to radio wave beacon of VICS, despite the limited area, a communication area is as large as about 70 m, a plurality of vehicles can enter to the same area and accordingly, there is a high possibility of receiving communication by an on-board apparatus of other unrelated vehicle. It is difficult to apply the radio wave beacon of VICS to a use requesting such a high individuality.

SUMMARY OF THE INVENTION

Hence, it is an object of the invention to provide an improved a short range wireless communication method.

According to the present invention, the method is implemented by using a short range wireless communication between an on-board apparatus mounted on a vehicle and an outside such as a fixed station. In this communication, millimetric wave of, for instance, 5.8 GHz is used, thus limiting the communication area to 3 meters to 30 meters. The power of millimetric wave attenuates very progressively as the transmission distance increases.

This communication method is applicable to a system in which a service is requested from a vehicle and a service charge is required, a vehicle history information is provided at a car repair shop, a warning of an opposing vehicle is provided at an invisible corner, or the like.

BRIEF DESCRIPTION OF THE DRAWINGS

The above and other objects, features and advantages of the present invention will become more apparent from the following detailed description made with reference to the accompanying drawings. In the drawings:

FIG. 10 is a schematic view showing sites of installing fixed stations in a system providing information for avoiding danger or the like;

DETAILED DESCRIPTION OF THE PREFERRED EMBODIMENT

Figure 1:
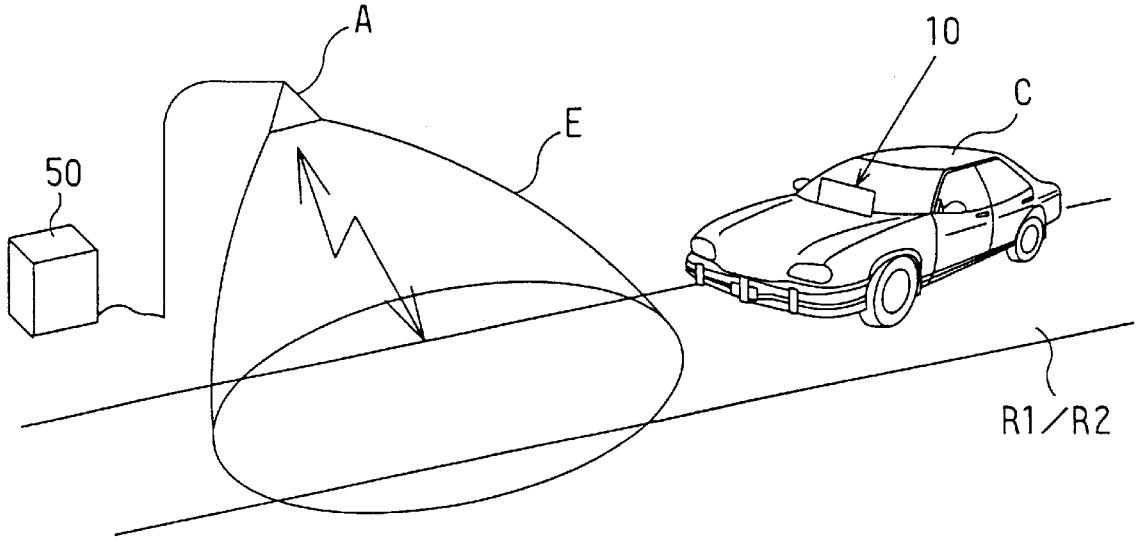
FIG. 1 is a schematic view showing a basic scheme of a wireless communication system according to an embodiment of the present invention.

As shown in FIG. 1, a wireless communication system according to an embodiment comprises an on-board apparatus 10 mounted on a vehicle C and a fixed station 50 for carrying out wireless communication with the on-board apparatus 10 by a short range wireless system such as a dedicated short-range communication system (DSRC).

Further, an antenna A of the fixed station 50 forms a communication area E having a size of about 3 through 30 meters and is installed such that the communication area E covers a general road R1 on which a vehicle C runs as well as running paths R2 of the vehicle in various facilities which a driver can drop in while the driver is riding the vehicle C.

Further, normally, a communication apparatus on the side of the fixed station 50 transmits a pilot signal for drives a communication apparatus (short range wireless unit 11 shown in FIG. 2A) on the side of the on-board apparatus 10 mounted in the vehicle at predetermined time intervals and carries out data communication with the on-board apparatus 10 in the case in which the communication apparatus on the side of the on-board apparatus 10 which has received the pilot signal, transmits a response signal so that the response signal can be received by the communication apparatus on the side of the fixed station 50.

In the meantime, the communication apparatus on the side of the on-board apparatus 10 transmits the response signal when the communication apparatus receives the pilot signal from the side of the fixed station 50 and thereafter carries out data communication with the communication apparatus on the side of fixed station 50.

Further, all of the data communication which is carried out between the fixed station 50 and the on-board apparatus 10 in this way, is executed under control of the fixed station 50. That is, the communication apparatus on the side of the fixed station 50 transmits a modulated signal modulated by the pilot signal or data to the on-board apparatus 10 during a predetermined period of transmission. Thereafter, the communication apparatus on the side of the on-board apparatus 10 transmits the response signal in response to the pilot signal or the data to the fixed station 50 during a predetermined period of response.

Figure 2A:
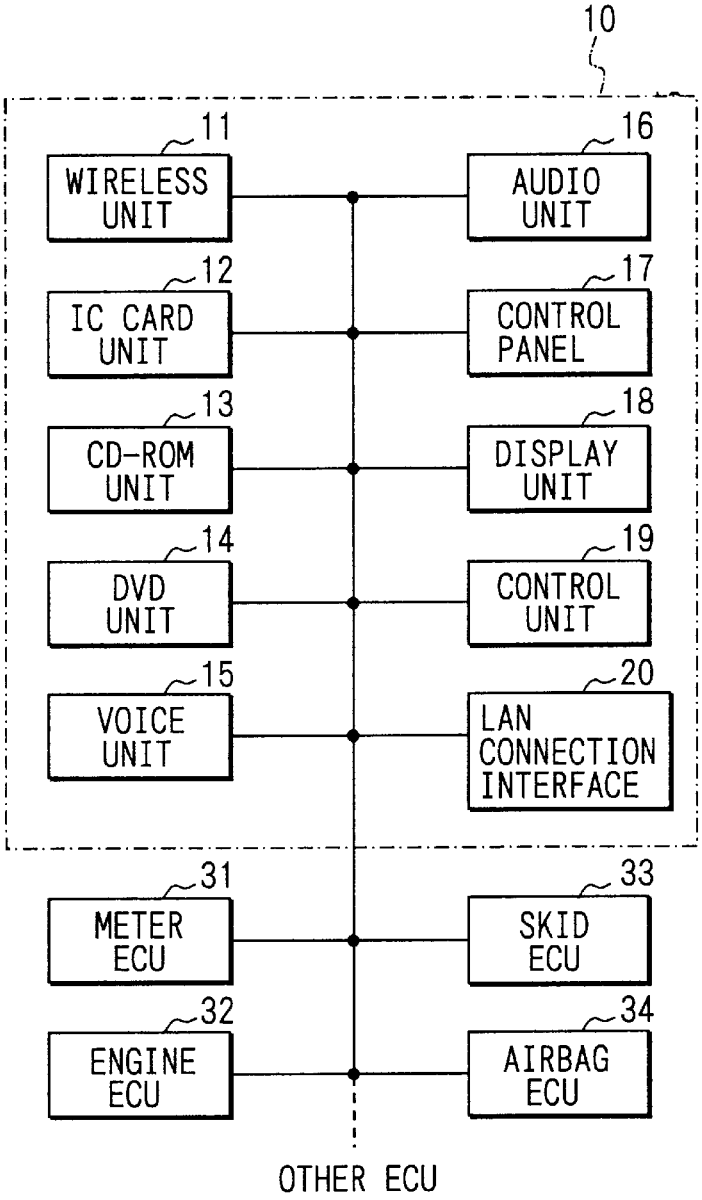
FIGS. 2A and 2B are block diagrams showing an on-board apparatus according to the embodiment.

As shown in FIG. 2A, the on-board apparatus 10 is provided with a short range wireless unit 11 as communicating means for carrying out wireless communication of the short range wireless system, an IC card unit 12 being attachably and detachably charged with an IC card including a cash card or a prepaid card for paying charge, various member's cards or the like for reading and writing data from and to the charged IC card, a CD unit 13 for reading data from CD-ROM, a DVD unit 14 for reading and writing data from and to DVD, and a voice unit 15 having a microphone, a speaker, an A/D converter, a D/A converter and the like for inputting and outputting voice. The apparatus 10 is further provided with an audio unit 16 for generating music by reading data from MD or CD, a control panel 17 as inputting means for inputting various instruction, a display unit 18 as displaying means for displaying various operational procedures and displaying information acquired via the short range wireless unit 11, and a control unit 19 comprising a microcomputer for controlling these various units.

Figure 2B:
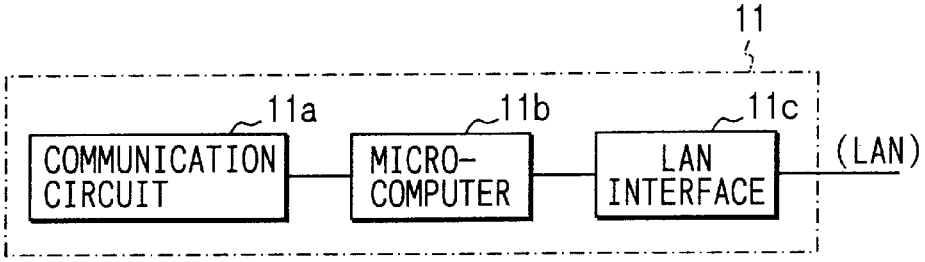

Further, as shown in FIG. 2B, each of these units is provided with a microcomputer and a LAN interface and is connected to LAN (Local Area Network) constructed in the vehicle via the LAN interface. Further, the on-board apparatus 10 is also provided with a LAN connection interface 20 comprising a hub, a jack or the like for additionally connecting a new unit to the in-vehicle LAN or for carrying out version-up of software or the like.

Further, the in-vehicle LAN is connected also with various electronic control units (ECUs) mounted in the vehicle such as a meter ECU 31 for carrying out various display of a speedometer, a tachometer and so on on a liquid crystal panel provided at an instrument panel. It is further connected to an engine ECU 32 for carrying out engine control, a skid ECU 33 for carrying out skid control, an airbag ECU 34 for carrying out airbag control and the like. Each ECU is constructed to be capable of communicating interactively with the other units and ECUs.

Figure 3:
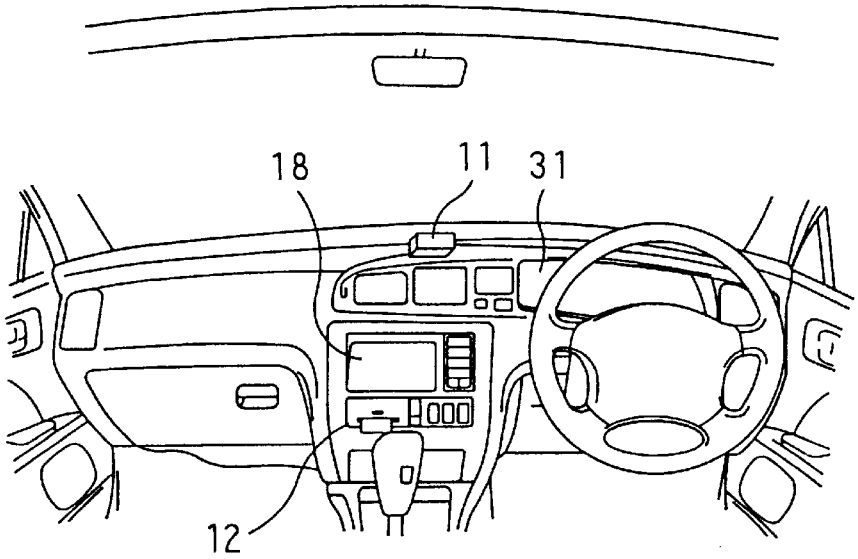
FIG. 3 is a schematic view showing a state of attaching the on-board apparatus.

As shown in FIG. 3, the units of the on-board apparatus 10 are arranged at locations adapted to functions of the respective units, or easily operable locations, locations having excellent visually recognizing performance or the like such that the short range wireless unit 11 is installed on a dashboard in order to excellently receive radio wave from the fixed station 50 and prevent interference with the other units. With regard to the other units, the display unit 18 and the IC card unit 12 are installed on the instrument panel.

The short range wireless unit 11 is provided with, as shown in FIG. 2B, a microcomputer 11*b* and a LAN interface 11*c* as well as a short range wireless communication circuit 11*a* for executing wireless connection with the fixed station 50.

Further, the microcomputer 11*b* is provided with a memory that may be a flash ROM, EEPROM, backup RAM and the like and is capable of rewriting data for storing a command table for specifying an application program to be started based on an application program in correspondence with a service provided from the fixed station 50 via the short range wireless communication circuit 11*a* and a command provided to reception data from the fixed station 50.

Further, the microcomputer 11*b* is also provided with a ROM exclusive for reading, which stores basic programs for carrying out a main processing for starting an application program in correspondence with a service provided by the fixed station 50 after starting data communication with the fixed station 50 and a loader processing for adding or updating the application program and the command table.

Figure 4:
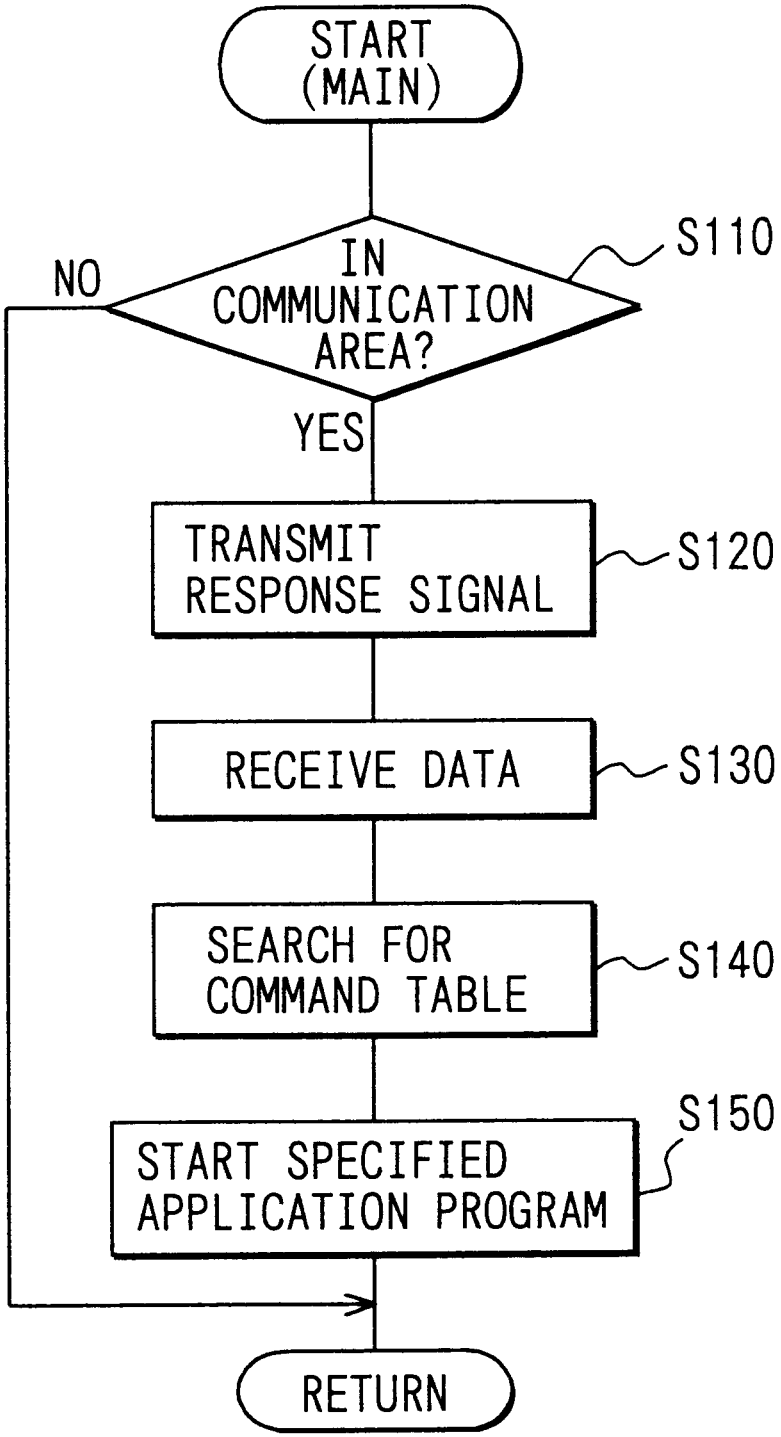
FIG. 4 is a flow diagram showing a main processing which a microcomputer of a arrow area wireless unit executes.

Here, the main processing executed by the microcomputer 11*b* of the short range wireless unit 11 is shown as in FIG. 4. When a power is switched on in the unit 11, the main processing is repeatedly executed.

As shown in FIG. 4, when the processing is started, firstly, at S110, it is determined whether a vehicle mounted with the on-board apparatus 10 enters a communication area of the fixed station 50. When the vehicle enters the area, the operation proceeds to S120. In the meantime, when the vehicle does not enter therein, the processing is finished as it is. Further, the determination of whether the vehicle enters the communication area or not can be determined by whether the short range wireless communication circuit 11*a* receives the pilot signal transmitted from the fixed station 50.

At S120, the on-board apparatus 10 transmits a response signal indicating that the pilot signal is received to the fixed station 50. The fixed station 50 which receives the response signal start transmitting data. Accordingly, at successive S130, the on-board apparatus 10 receives data transmitted from the fixed station 50.

Further, at S140, a command included in the data received at S130 is extracted to search for a command table stored in the memory based on the extracted command. At successive S150, an application program specified as a result of the table search is started, thus finishing the main processing. However, if the extracted command is not registered in the command table, no operation is executed at S150 and the processing is finished as it is.

The on-board apparatus 10 is constructed to be capable of dealing with various services provided by the fixed station 50 by previously registering necessary application programs. The application program may be registered or updated by, for example, mounting an IC card connector connected to a data terminal to the IC card unit 12 and transferring the application program to be registered or updated from the data terminal to the microcomputer 11*b* of the short range wireless unit 11 via LAN. Further, the application program may be downloaded when an IC card written with an application program to be registered or updated is charged to the IC card unit 12. However, in this case, it is preferable that a program in the IC card is made ineffective once the application program is downloaded.

Further, a program rewriting device M having a communication apparatus for short range wireless communication may be used in the same manner as that used in the fixed station 50 and a memory storing an application program to be registered or updated. In this instance, the application program stored in the memory as data transmitted to the on-board apparatus 10 may be transmitted to thereby directly supply the application program to the short range wireless unit 11 by wireless communication without using the IC card unit 12.

Figure 5A:
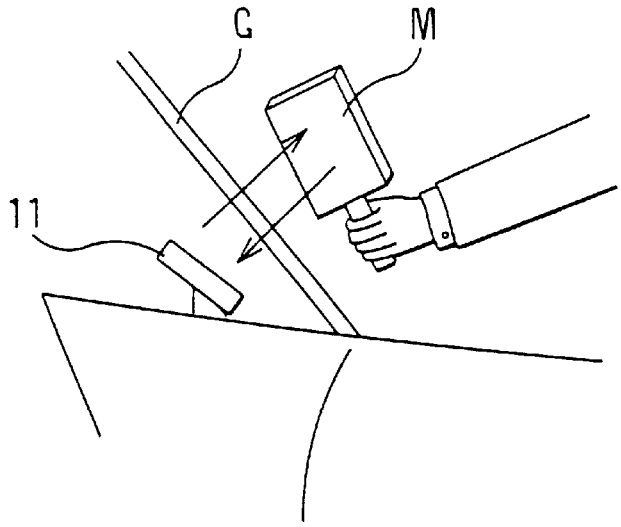
FIGS. 5A, 5B and 5C are schematic views showing methods of using a program rewriting device for registering and updating application programs.
Figure 5B:
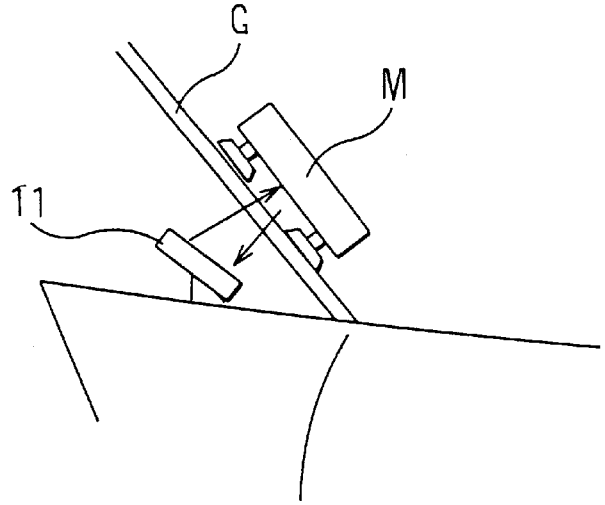
Figure 5C:
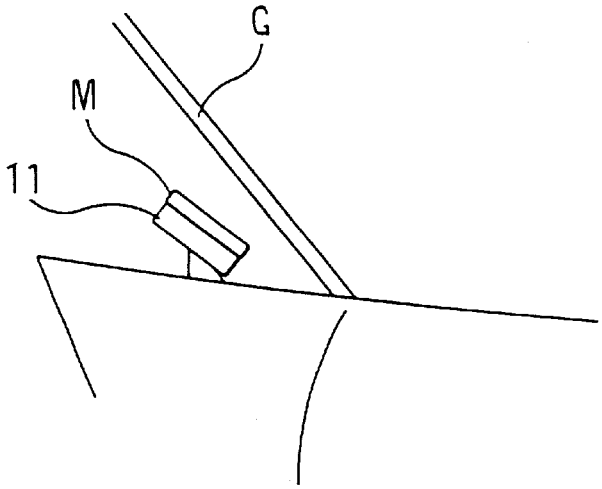

Further, as shown in FIGS. 5A, 5B and 5C, various types of the program rewriting device M may be used. The types may be, for example, a hand-held type (FIG. 5A), a type which is attached to front windshield G in opposition to the short range wireless unit 11 (FIG. 5B), and a type which is brought into direct contact with the short range wireless unit 11 (FIG. 5C) and so on.

Figure 6:
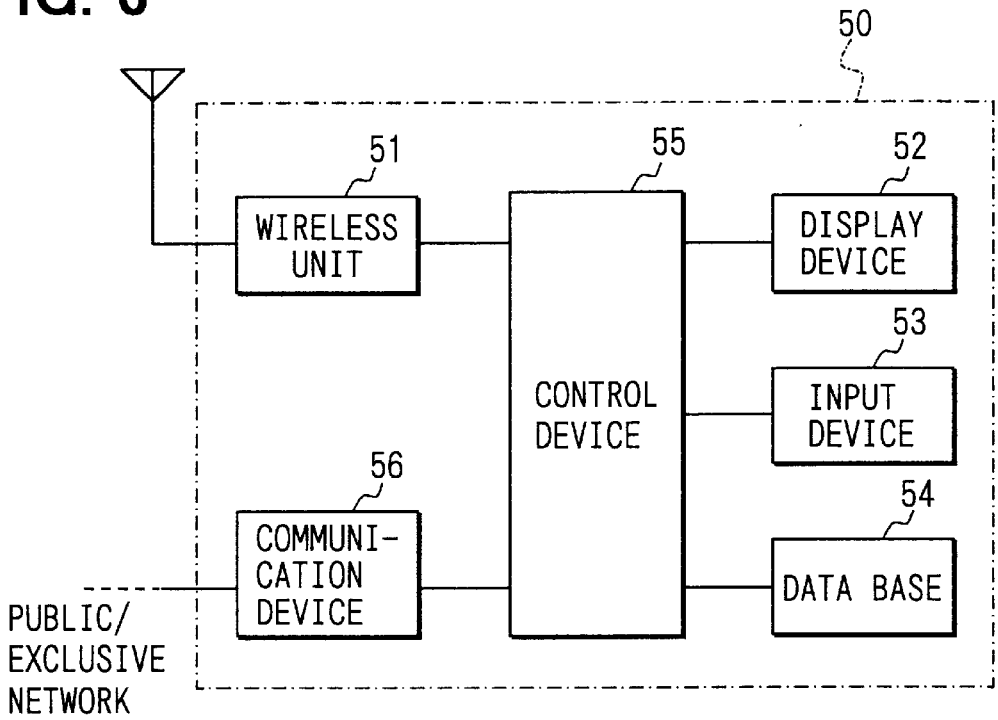
FIG. 6 is a block diagram showing a fixed station.

The fixed station 50 may be constructed as shown in FIG. 6. This construction is adapted for a case in which order is received and charge is settled in a drive-through mode where commodities are ordered and received by a driver while staying in the vehicle. In this case, the antenna of the fixed station 50 is installed such that the communication area is formed at a position where the vehicle is stopped in ordering commodities, and the communication area is set to cover an area that corresponds to a degree of one vehicle.

As shown in FIG. 6, the fixed station 50 is provided with a Short range wireless unit 51, a display device 52 for displaying various operation procedures, information acquired via the short range wireless unit 51 and the like, an input device 53 for inputting various instructions, a data base 54 storing menu information or the like provided to the on-board apparatus 10, a control device 55 for executing order and reception processing by controlling the respective unit and devices and a communication device 56 for communicating with a center or the like provided outside via a public network or an exclusive network.

When the response signal from the on-board apparatus 10 in response to the pilot signal is received by the short range wireless unit 51, the control device 55 transmits menu information and corresponding names of providable commodities together with their prices along with a previously determined menu selection command. Thereafter, when operational information specifying desired commodities is received from the on-board apparatus 10, in accordance therewith, order content is displayed on the display device 52. When the operation information is provided with information for settlement of charge (ID data of IC card), a charge settlement processing is carried out by communicating with the on-board apparatus 10 successively via the short range wireless unit 51.

Next, a menu selection command processing is described with reference to FIG. 7. This processing is executed by the microcomputer when the short range wireless unit 11 of the on-board apparatus 10 receives the menu selection command. The processing is started by executing S150 of the main processing in accordance with the received menu selection command.

Figure 7:
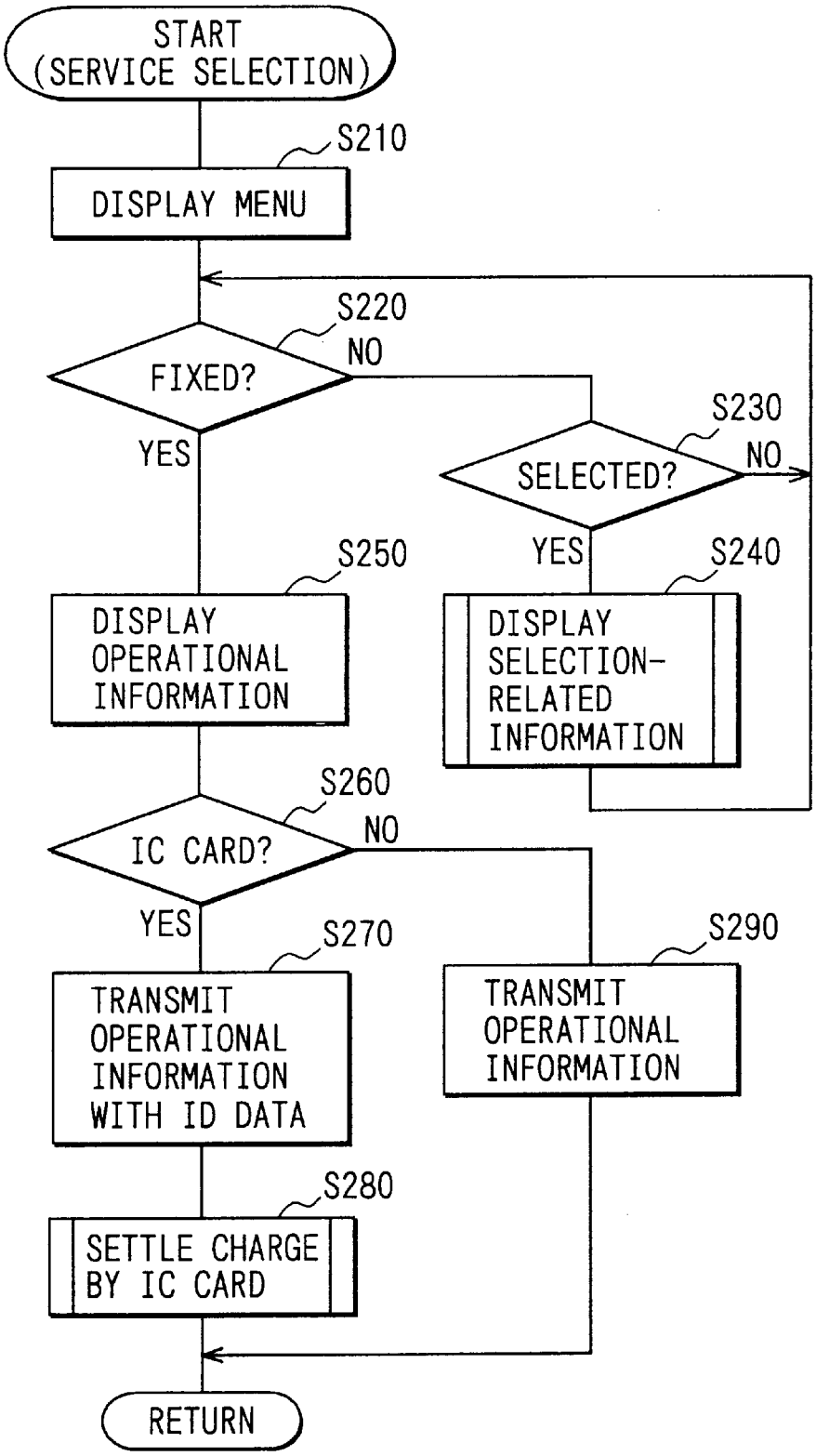
FIG. 7 is a flow diagram showing a service selection command processing.
Figure 8A:
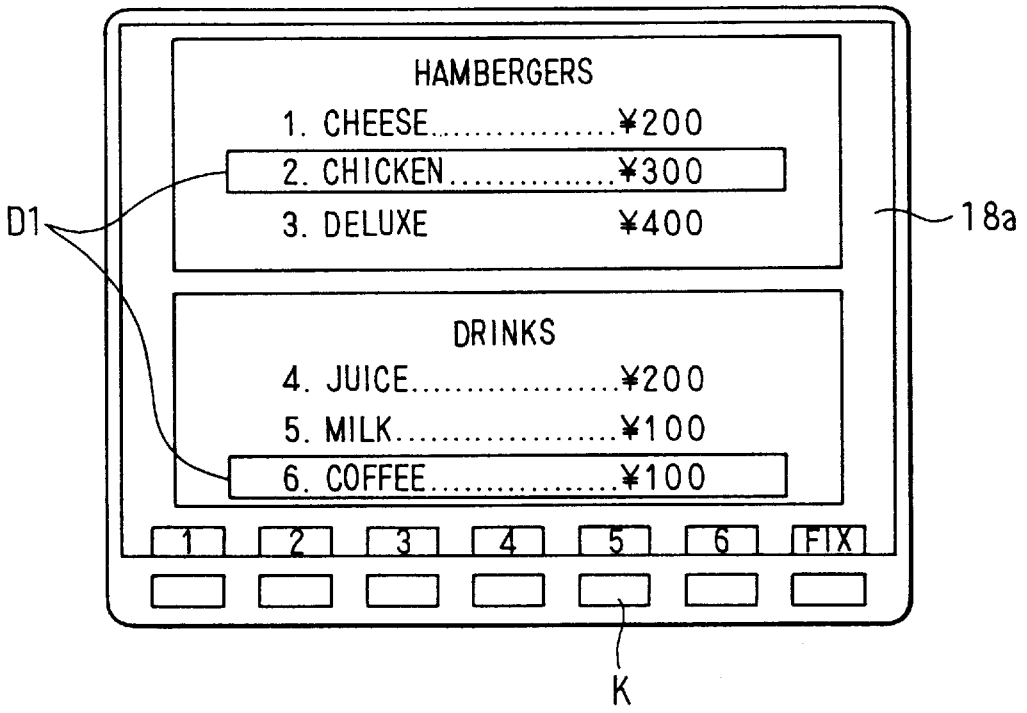
FIGS. 8A and 8B are schematic views showing display examples on a display unit.

As shown in FIG. 7, when the processing is started, firstly, at S210, the menu is displayed on a display panel 18*a* of the display unit 18 in accordance with menu information which is data received from the fixed station 50 (FIG. 8A).

At successive S220, it is determined whether determination or fixing operation which is executed in finishing the menu selection via operation keys K of the control panel 17 is made. When the determination operation is not carried out, the operation proceeds to S230. In this case, it is determined whether there is carried out selection operation which is executed in selecting desired items in the menu. When the selection operation is not carried out, the operation returns to S220.

When it is determined that the selection operation is carried out at S230, the operation proceeds to S240, executes a display processing in correspondence with the selection operation and returns to S220. According to the display processing in correspondence with the selection operation, specifically, for example, when a scroll key is operated, a display screen is switched. When keys for selecting commodities are operated, display portions of the selected commodities are displayed to highlight the item as indicated by D1 in FIG. 8A.

Figure 8B:
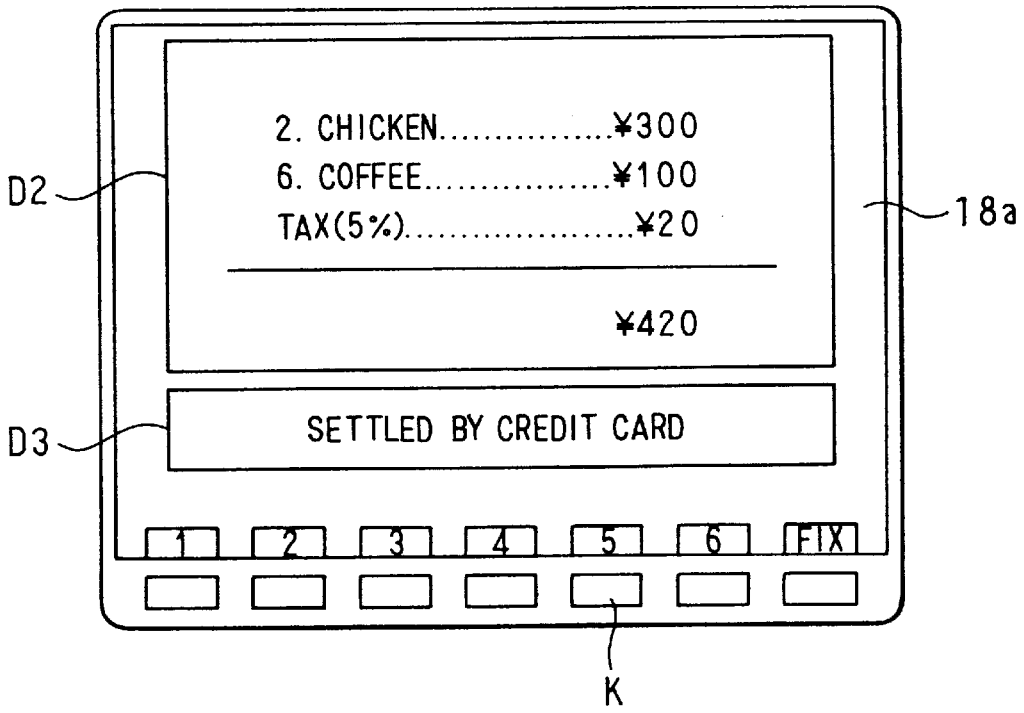

In the meantime, when it is determined that the determination operation has been carried out at S220, the operation proceeds to S250 and displays operational information indicating a list of the commodities selected by the selection operation and a total amount of money on the display unit 18 as indicated by D2 in FIG. 8B.

Successively, at S260, it is determined whether an IC card for settling charge is charged to the IC card unit 12. When the IC card is not charged, the operation proceeds to S290 to settle charge by cash, transmits only operational information to the fixed station 50 and finishes the processing.

In the meantime, at S260, when it is determined that the IC card is charged, the operation proceeds to S270 to settle charge by the IC card, Id data or the like is read from the IC card and transmitted to the fixed station 50 along with the operational information. At successive S280, data is exchanged with the fixed station 50 for settling charge and based on the data, content of the IC card is updated and finishing of charge settlement is displayed as indicated by D3 in FIG. 8B, thus finishing the processing.

According to the wireless communication system of this embodiment applied to the system executing reception of order and charge settlement in a drive-through shop, order operation or settlement operation can be carried out without making a conversation by opening a window of the vehicle and receiving and delivering cash at the order reception site. Thus, time and labor of a series of operation required for receiving services can considerably be reduced.

Further, communication between the on-board apparatus 10 and the fixed station 50 is carried out in a short range wireless communication, and therefore the communication area can be set to be small. It can be prevented that a signal from the same fixed station 50 is simultaneously received by the on-board apparatus 10 of a plurality of vehicles. As a result, the wireless communication system is applicable preferably to systems which need the individuality of the communication such as settlement of charge or the like.

Further, the short range wireless can deal with communication of one (fixed station 50) versus 'n' of (on-board apparatus 10). Therefore, the communication area can be set to be larger, and orders from a plurality of vehicles can be simultaneously received. In this case, it is preferable to include identification information of, for example, body color, type of car, name of car or the like in information transmitted from the on-board apparatus 10 to the fixed station 50 to be capable of determining from which vehicle order is issued in supplying the ordered commodities.

Further, voice information maybe added to the menu information or information for charge settlement and transmitted such that voice of "please push buttons of the order" when the menu is displayed on the display unit 18 or voice of "thank you", or "please proceed forwardly" is provided. Further, image or live voice of a shop employee may be transferred via the short range wireless communication. Further, a conversation can be made in two- way by utilizing a microphone unit attached to the on-board apparatus 10.

The wireless communication system is also applied to read history information indicating operational history of respective portions of a vehicle from the vehicle. In this case, the antenna A of the fixed station 50 is installed on a vehicle travel path to a car dealer shop receiving inspection or repair or a factory actually carrying out inspection or repair, thus defining a communication area.

The fixed station 50 is constructed in the same manner as the fixed station 50 (FIG. 6) of the wireless communication system applied to the system for receiving order and settling charge at the drive-through shop. The data base 54 stores information of respective vehicles (users), that is, past history information, information with regard to inspection and repair or the like, and the display apparatus 52 displays content of history information acquired via the short range wireless unit 51 or past information read from the data base 54. Here, as history information, specifically, there are, for example, condition of engine ECU, ABS ECU, sensor operation of airbag, lamps, brake pad wear degree, oil interchange time, fuel cost situation and so on.

Further, when the response signal from the on-board apparatus 10 responsive to the pilot signal is received by the short range wireless unit 51, the control device 55 transmits a previously determined history inquiry command. When the history information is received from the on-board apparatus 10 as response to the history inquiry command, the control device 55 executes processing of displaying the received history information on the display device 52, accumulating the history information in the data base 54 and the like. Further, when ID data for identifying the user of the vehicle is received along with the history information, the data base 54 is searched in accordance with the ID data. The display device 52 also displays past information stored in the data base 54. The acquired history information is accumulated in the data base 54 in correspondence with the past information.

Figure 9:
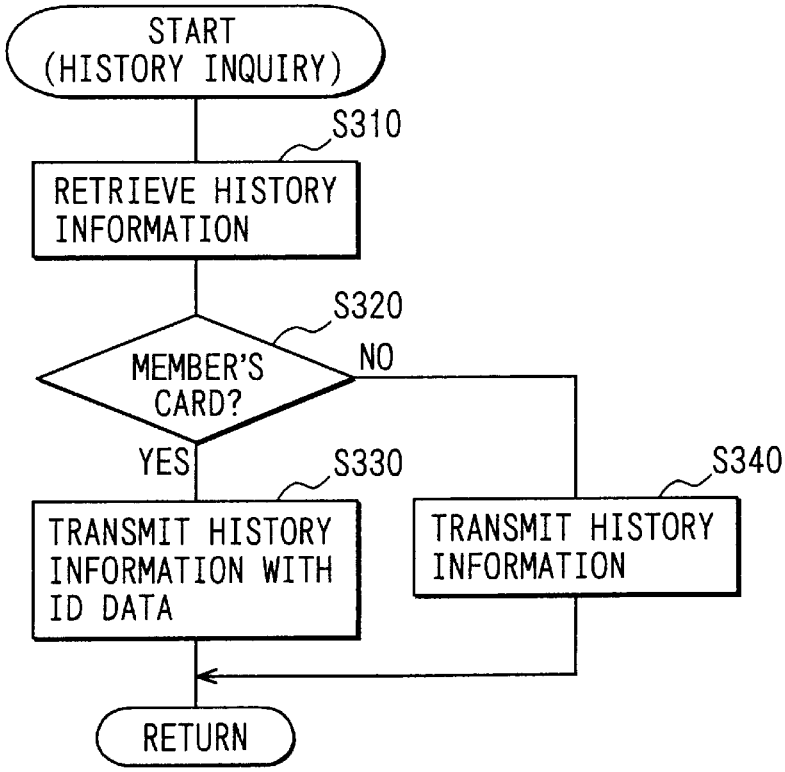
FIG. 9 is a flow diagram showing a history inquiry command processing.

FIG. 9 shows a history inquiry command processing which the short range wireless unit 11 of the on-board apparatus 10 executes upon receiving the history inquiry command. This processing is started by executing S150 of the main processing (FIG. 4) in response to the received history inquiry command.

As shown in FIG. 9, when the processing is started, firstly, at S310, accumulated history information is retrieved from the engine ECU32, the skid ECU 33, the airbag ECU 34 and the like. At successive S320, it is determined whether a member's card (IC card) issued by the car dealer at which the fixed station 50 is installed is charged to the IC card unit 12.

When the member's card is charged, the operation proceeds to S330. The ID data specifying the owner of the member's card is retrieved from the member's card. The ID data is added to the history information retrieved at S310 and transmitted to the fixed station 50 to thereby finish the processing.

In the meantime, when the member's card is not charged, the operation proceeds to S340. only the history information read at S310 is transmitted to the fixed station 50 to thereby finish the processing.

In this way, according to the wireless communication system of this embodiment, the history information accumulated in the vehicle can be collected simply and swiftly without carrying out special operation. Further, in this case, personal information (address, name, telephone number) is stored to the member's card (IC card) and transmitted. When the personal information is not intended to be transmitted, the member's card need not be charged thereby to protect privacy. Further, a selection of whether the personal information stored to the member's card is to be transmitted can be set by a control apparatus installed in the on-board apparatus 10.

Further, even in the case in which inspection or repair is not particularly carried out, when the fixed station 50 is installed such that the history information can be retrieved periodically, abnormality of the vehicle can swiftly be detected and occurrence of failure or accident based on failure can firmly be reduced.

The wireless communication system is also applied to provide useful information for avoiding danger or the like at a site under a special situation such that danger in running a vehicle is high or the like.

Figure 10:
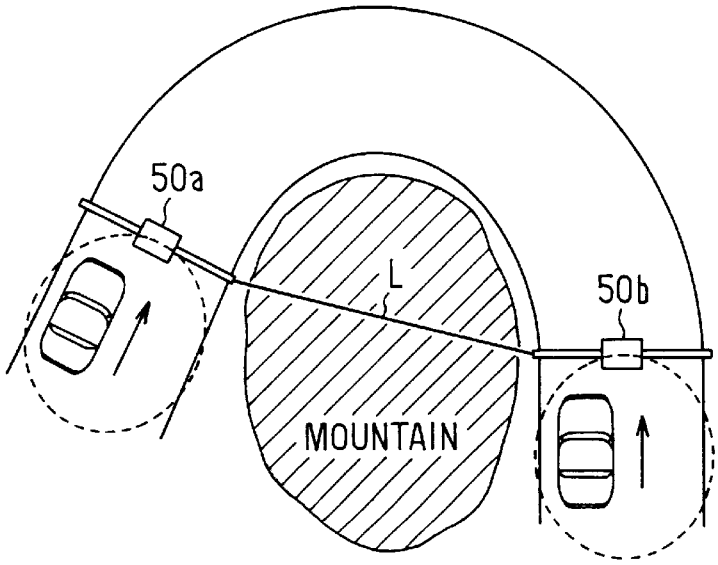

Particularly, in this case, information is provided at a blind corner, that is, a curved corner where the forward side is not seen. As shown in FIG. 10, fixed stations 50*a* and 50*b* are installed respectively in the vicinity of two ends of the corner where the field of vision is blocked due to a mountain. The two fixed stations 50*a* and 50*b* are connected to each other via a communication line L. A section between the two installed fixed stations 50*a* and 50*b* is referred to as an object area.

Figure 11:
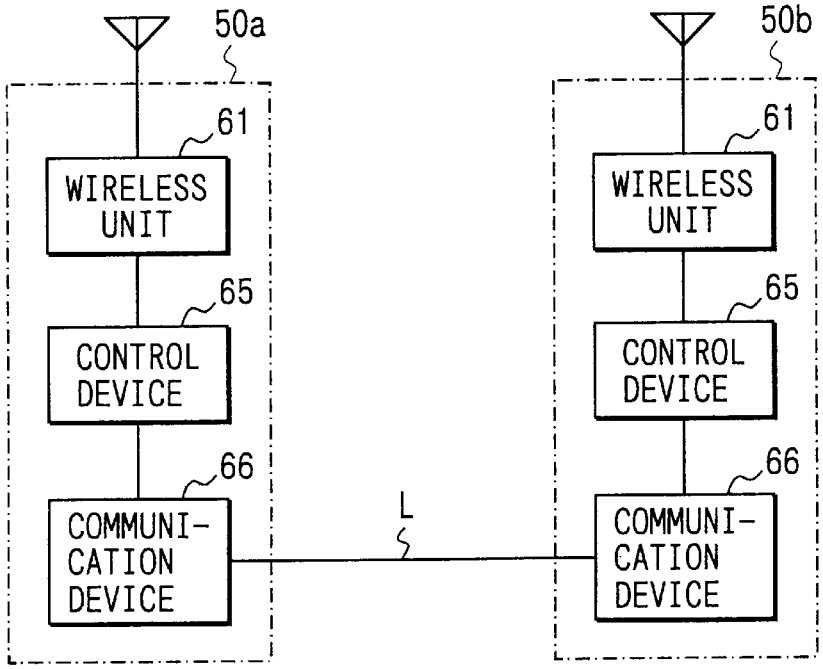
FIG. 11 is a block diagram showing the fixed stations.

As shown in FIG. 11, the fixed stations 50*a* and 50*b* are constructed similarly to each other. Each station has a short range wireless unit 61 for carrying out communication with the on-board apparatus 10, a communication device 66 for communicating with the opposing fixed station and a control device 65 for collecting and providing information with regard to the object area by controlling the short range wireless unit 61 and the communication device 66. The memory of each control device 65 stores running path information with regard to conditions of a road of the object area, for example, radius of curvature, slope, road width, road surface condition and so on.

When the response signal from the on-board apparatus 10 in response to the pilot signal is received by the short range wireless unit 61, in the case in which a vehicle mounted with the on-vehicle device 10 which has transmitted a response signal is running in a direction of advancing to the object area, the control device 65 transmits a previously determined vehicle control start command and transmits a vehicle control finish command in the case in which the vehicle is running conversely in a direction of retreating from the object area.

The control devices 65 are constructed to count respectively vehicles advancing to the object area and vehicles retreating from the object area, and mutually provide the opposing fixed stations 50*a* and 50*b* connected via the communication devices 66 with the count information on vehicles advancing to the object area. Further, based on count information on vehicles advancing to the object area acquired from the opposing station and count information on vehicles retreating from the object area detected by the fixed station of its own, it is detected whether vehicles which have enterd the object area from the side of the count station, that is, it is detected whether opposing vehicles are present in the object area. The detected result is added to the vehicle control start command along with the running path information stored in the memory as running vehicle information and is provided to the on-board apparatus 10.

Figure 12:
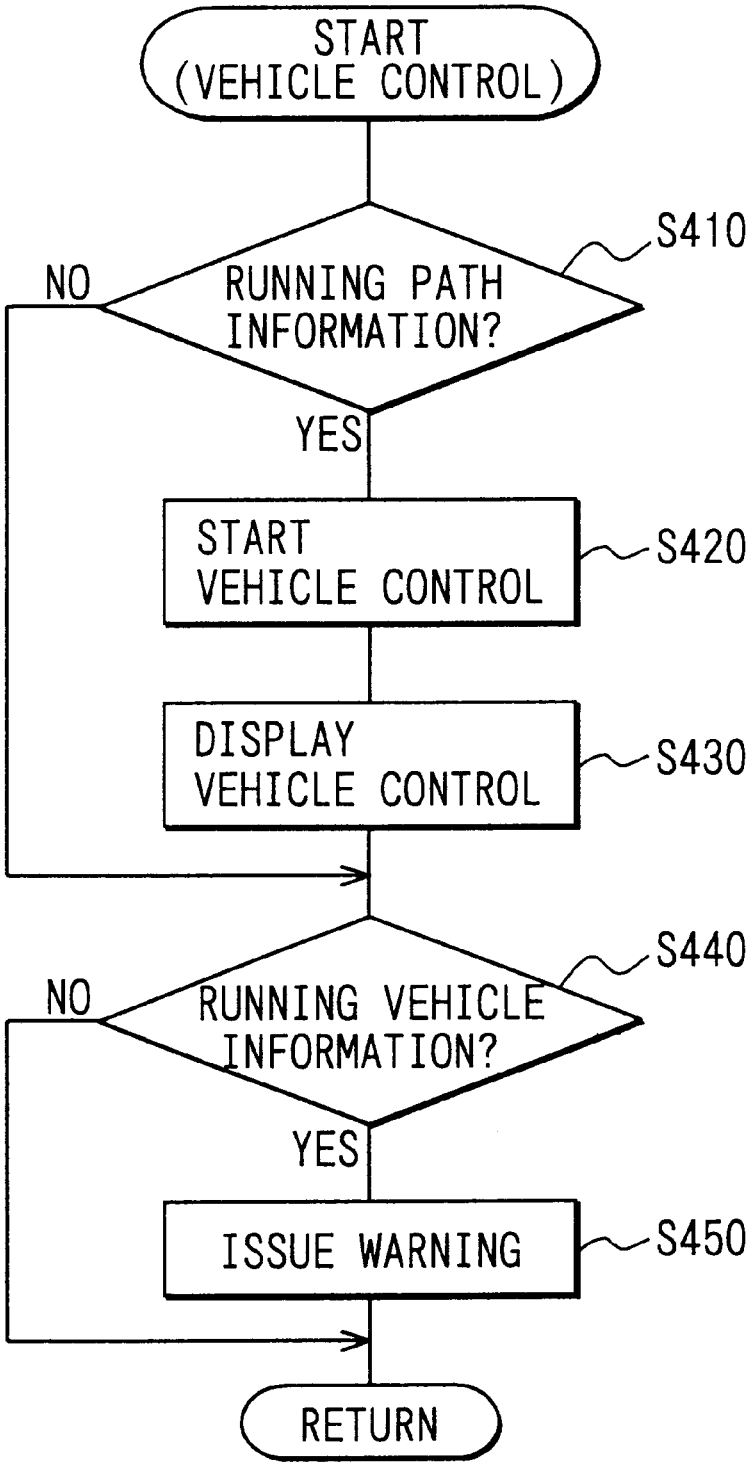
FIG. 12 is a flow diagram showing a vehicle control command processing.

FIG. 12 shows a vehicle control command processing which the short range wireless unit 11 carries out by the microcomputer 11*b*. The processing is started by carrying out S150 of the main processing, in response to the received vehicle control start command.

When the processing is started, firstly, at S410, it is determined whether there is the running path information in the received data. When there is not the running path information, the operation proceeds to S440. In the meantime, when there is the running path information in the received data, the operation proceeds to S420 and starts vehicle control in accordance with the running path information. In this case, in accordance with the running path information (radius of curvature, slope or the like), an upper limit speed is set so that the vehicle can travel safely without deviating from the vehicle lane. The skid ECU 33 is made to execute brake control such that the vehicle speed is restricted to be equal to or slower than the upper limit restricted speed.

At successive S430, the driver is informed of the fact that vehicle control is being carried out by the vehicle control start command by displaying the fact on the display unit 18 or the like, and the operation proceeds to S440.

At S440, it is determined whether the running vehicle information is present in the received data. When there is not the running vehicle information, the processing is finished as it is. When there is the running vehicle information, the running vehicle information is informed to the driver by, for example, driving the voice unit 15 to issue voice warning of "opposing vehicle is approaching", or "take care" or the like, thus finishing the processing. The vehicle control started at S420 is made to stop when the vehicle control stop command is received from the fixed station 50 in retreating from the object area.

According to this embodiment, approach of opposing vehicle which is not seen from the driver can be informed to the driver and the vehicle control can be carried out forcibly such that the vehicle can run the corner safely. Thus, occurrence of head-on collision at a dangerous site such as a blind corner can be prevented.

Further, communication between the on-board apparatus 10 and the fixed stations 50*a* and 50*b* is carried out by using the short range wireless communication capable of setting a small communication area and capable of carrying out data communication at high speed. Therefore, as in the above running path information and running vehicle information, information which is useful in an extremely limited section, particularly running vehicle information in an extremely limited period of time can be provided precisely and firmly only to vehicles necessitating the information, that is, vehicles which are going to enter the object area and can firmly prevent erroneous vehicle control from being started when an unrelated vehicle receives information from the fixed stations 50*a* and 50*b*.

Further, instead of transmitting the vehicle control stop command, the vehicle control may be stopped in the case in which the vehicle has run a constant distance or a constant time period has elapsed. A determination of presence or absence of vehicles in the object area may not be dependent on the short range wireless unit 51 but may be detected by a sensor or the like separately provided. The fixed stations 50*a* and 50*b* may provide the on-board apparatus 10 with information with regard to the upper limit speed calculated based on the running path information in place of the running path information or may provide the on-board apparatus 10 with information with regard to a road surface condition (dry, wet, icy) detected by a sensor or the like separately provided.

Further, the on-board apparatus 10 comprises the plurality of units connected via the in-vehicle LAN and the units can arbitrarily be dispersed or integrated (combined) and therefore, positions of attaching thereof can freely be selected. For example, although currently, an airbag or various sensors are attached to the dashboard and therefore, it is difficult to newly attach large-sized apparatus, only the short range wireless unit 11 which needs to install at a site commanding an unobstructed view in the on-board apparatus 10, can be attached even above the dashboard with no problem.

The above embodiment may be modified in various ways. For example, the on-board apparatus 10 need not be provided with all the units shown in FIG. 2. That is, in utilizing service of a system for receiving order and settling charge, only the short range wireless unit 11, IC card unit 12, the control panel 17 and the display unit 18 may be provided. In utilizing service of a system for collecting history information of vehicle, only the short range wireless unit 11 and the IC card unit 12 may be provided. In utilizing service of a system for providing information for controlling the vehicle, only the short range wireless unit 11 and the voice unit 15 may be provided.

Figure 13:
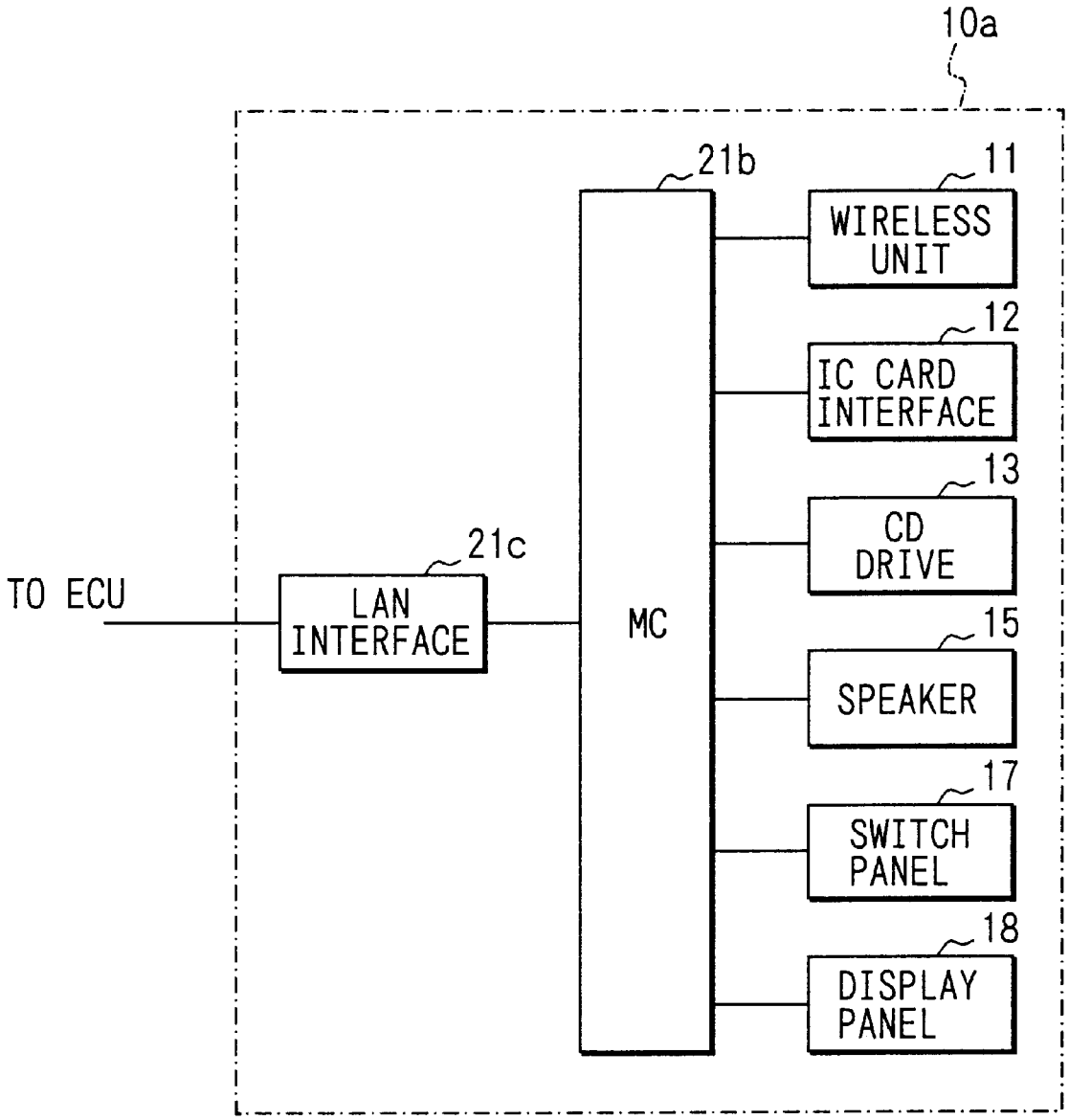
FIG. 13 is a block diagram showing an on-board apparatus according to a modification of the embodiment of the present invention.

Further, as shown in FIG. 13, the on-board apparatus 10 may be modified to an on-board apparatus 10*a* which has a single microcomputer 21*b* and a single LAN interface 21*c*. According to the on-board apparatus 10*a*, in comparison with the on-board apparatus 10, the microcomputer and the LAN interface can considerably be reduced.

Figure 14:
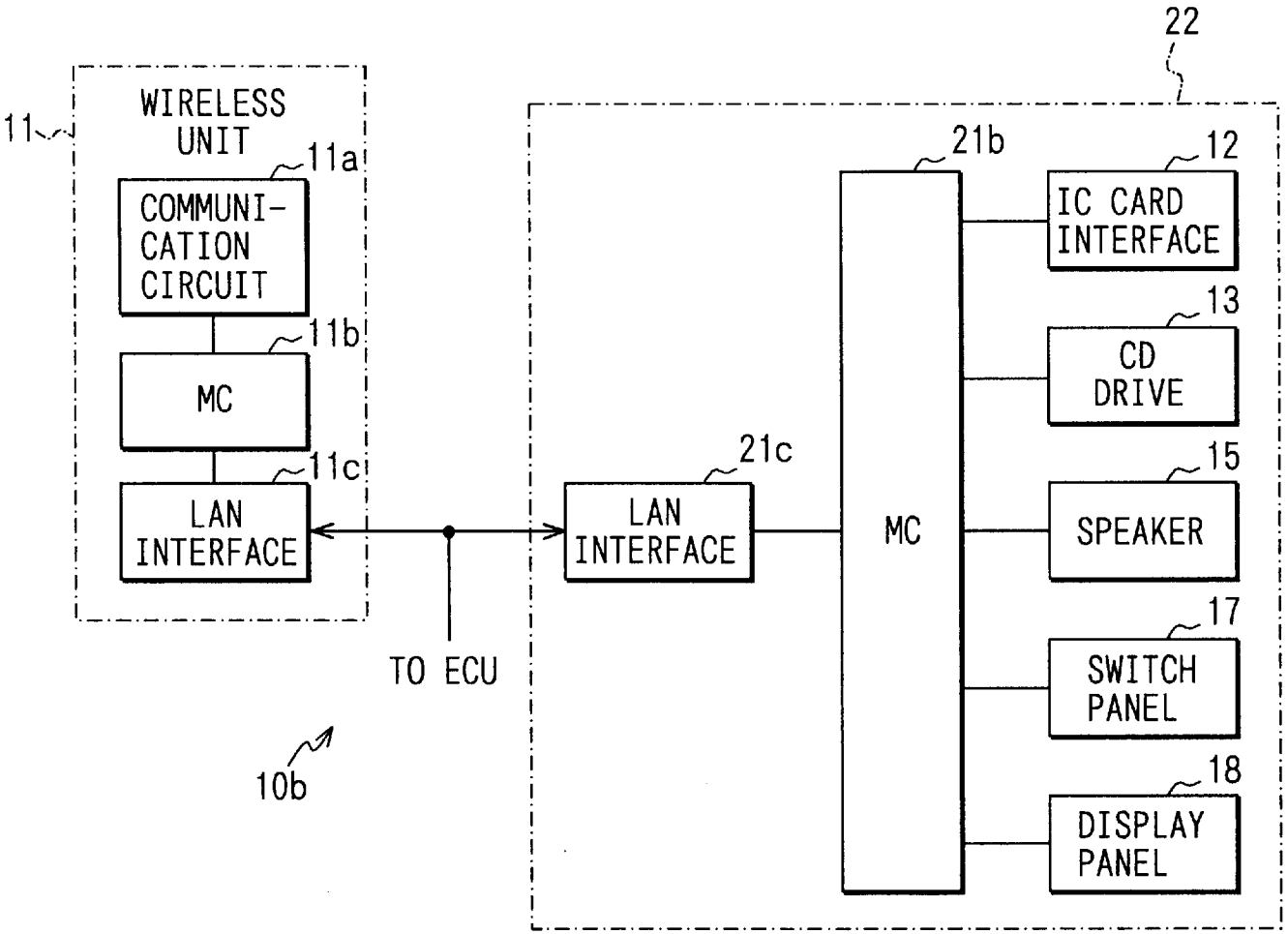
FIG. 14 is a block diagram showing an on-board apparatus according to a modification of the embodiment of the present invention.

Further, it is not necessary to integrate all the units. The on-board apparatus 10 may be modified to an on-board apparatus 16*b* as shown in FIG. 14. A composite unit 22 has no short range wireless unit 11, and may be connected to the short range wireless unit 11 via an in-vehicle LAN.

Figure 15:
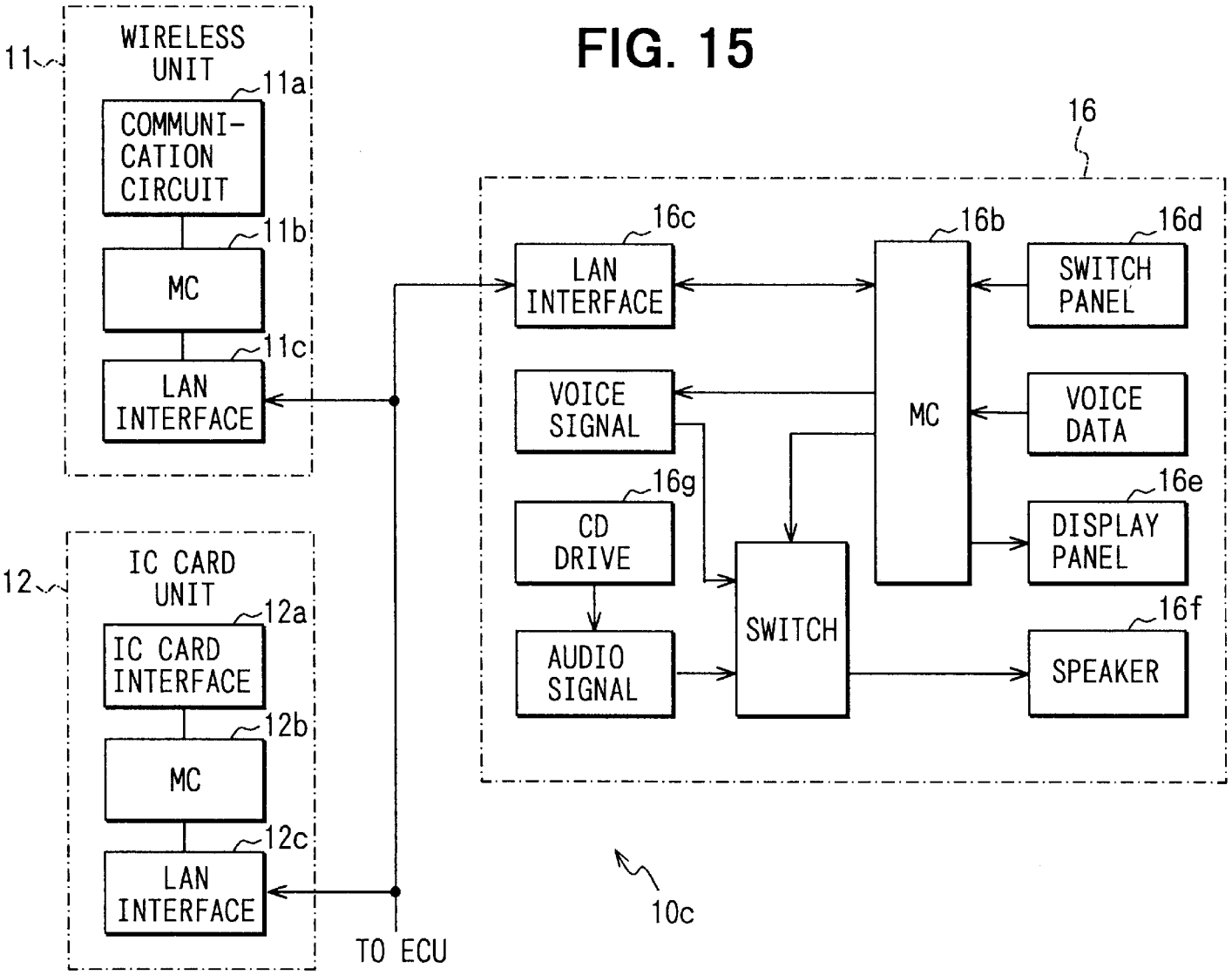
FIG. 15 is a block diagram showing an on-board apparatus according to a modification of the embodiment of the present invention.

When the audio unit 16 is provided with a switch panel 16*d*, a display panel 16*e*, a speaker 16*f*, a CD drive 16*g* and so on as shown in FIG. 15, an on-board apparatus 10*c* may be constructed by connecting the audio unit 16, the short range wireless unit 11 and the IC card unit 12 via an in-vehicle LAN. When power is not switched on in the composite unit 22 or the audio unit 16, service of a wireless communication system using image or voice cannot be received. In such a case, it is preferable to construct the short range wireless unit 11 to be able to start (power source ON) a unit necessary for receiving service.

Figure 16:
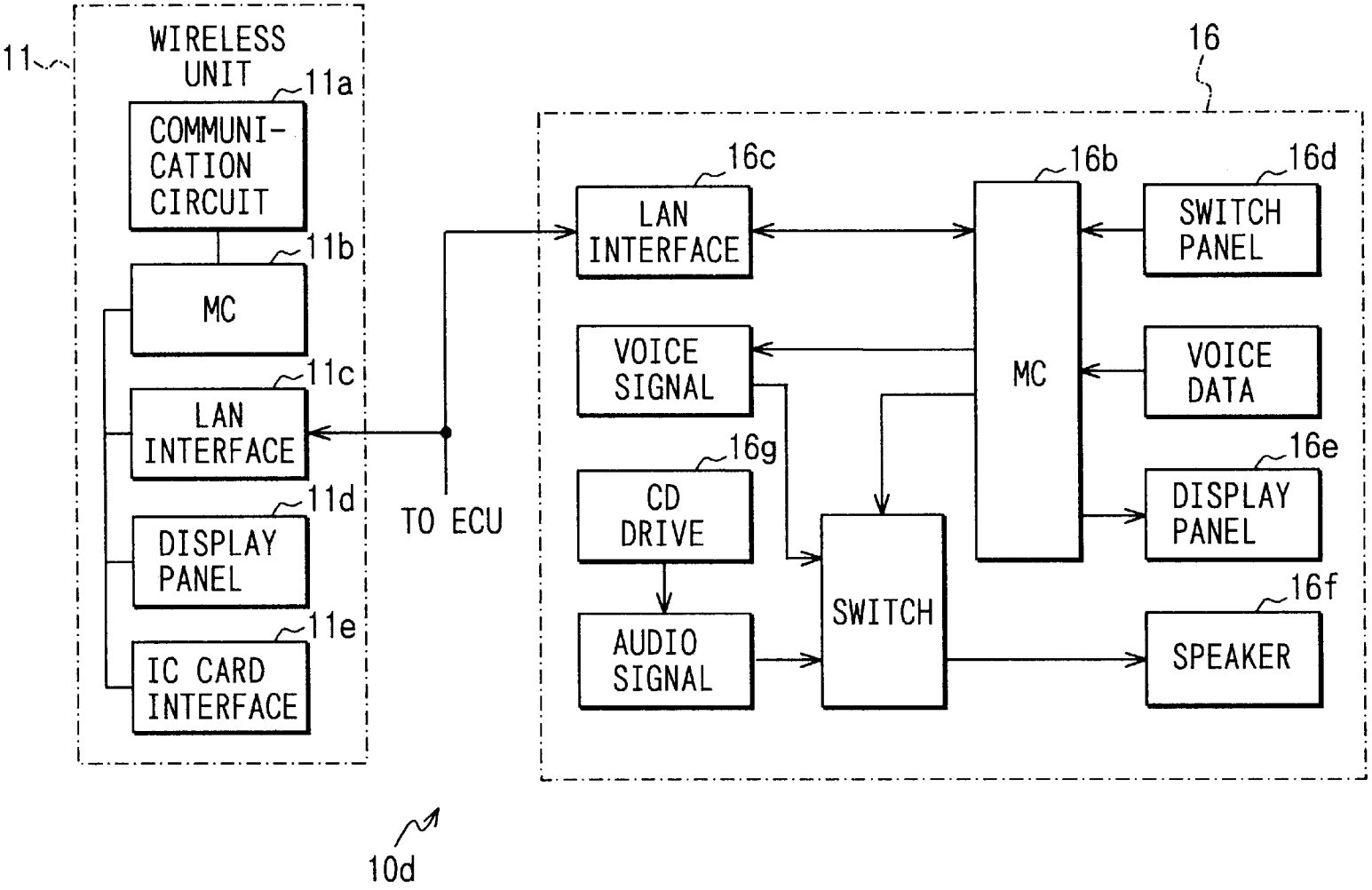
FIG. 16 is a block diagram showing an on-board apparatus according to a modification of the embodiment of the present invention.

As shown in FIG. 16, an on-board apparatus 10*d* may be constructed in such a manner that the display panel 11*d* and an IC card interface 11*e* are integrated in the short range wireless unit 11. In this case, even when other unit (audio unit 16) stops operating, when only the short range wireless unit 11 is started, a service utilizing only the display panel 11*d* or the IC card interface 11*e* (for example, settlement of rate of expressway) can be received.

Figure 17A:
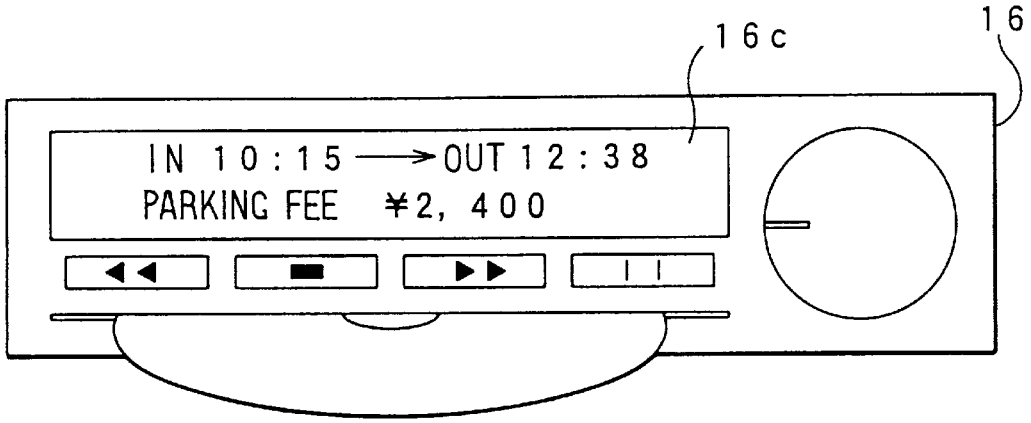
FIGS. 17A and 17B are schematic views showing other display examples.
Figure 17B:
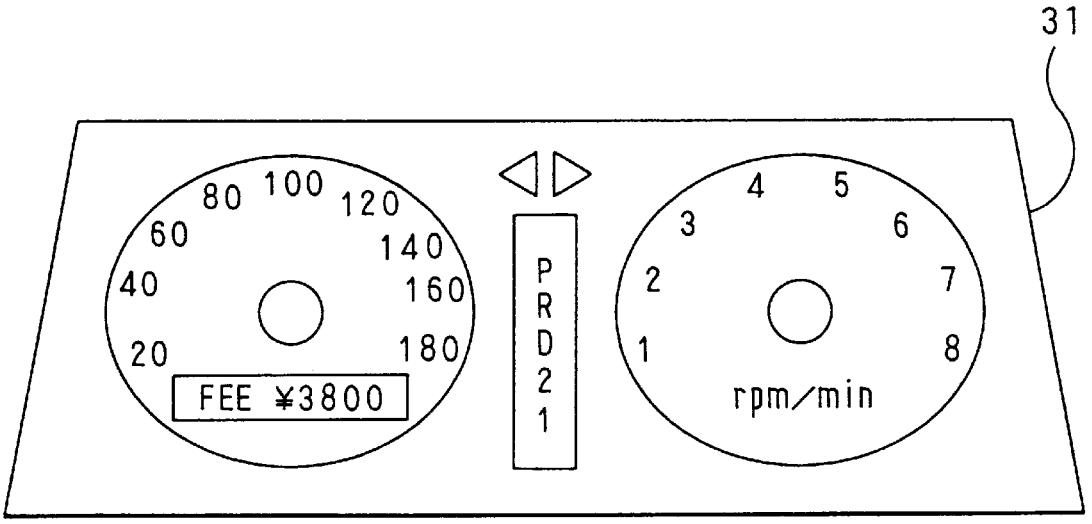

In place of various display with regard to service provided via the short range wireless unit 11 or together with the same, the audio unit 16 or the meter unit 31 may be made to carry out various display by using a display panel provided in the audio unit 16 as shown in FIG. 17A or by using a display panel controlled by the meter unit 31 as shown in FIG. 17B.

Further, in place of registering or updating application programs via the IC card unit 12 or the short range wireless unit 11, the operation may be carried out via a data terminal connected to the LAN connecting interface 20 or may be carried out via an apparatus for storing application programs to outside storage media of CD, MD, DVD, cassette tape and the like and retrieving data from these outside storage media.

What is claimed is:

1. A communication method using an on-board apparatus having communication means by using a short range wireless unit, the communication method comprising the steps of:

acquiring information for receiving service via the communication means;

displaying information acquired by the information acquiring step;

checking input operation information in accordance with the information displayed by the displaying step;

transmitting the input operation information checked by the checking step via the communication means;

reading and writing information from and to an IC card; and carrying out an information processing with regard to a service provided in accordance with the operation information transmitted by the transmitting step by transmitting and receiving the information of the IC card.

2. The communication method of claim 1, further comprising the step of:

carrying out wireless communication between the on-board apparatus and a fixed station having a limited communication area when the on-board apparatus is present in the communication area, wherein the on-board apparatus is mounted on a vehicle, and wherein the fixed station is installed in a vicinity of a site of receiving order of a store in which the order with respect to the service can be carried out by a driver while staying in the vehicle.

3. The communication method of claim 1, wherein the reading and writing of information from and to an IC card further comprises reading identification data from the IC card and writing an updated identification data to the IC card.

4. The communication method of claim 3, wherein the transmitting the input operation information checked by the checking step via the communication means further comprises transmitting the identification data read from the IC card along with the input operation information.

* * * * *